US005864928A

United States Patent [19]

Matsushima

[11] Patent Number: 5,864,928

[45] Date of Patent: Feb. 2, 1999

[54] SLIDE FASTENER SLIDER

[75] Inventor: Hideyuki Matsushima, Toyama-ken, Japan

[73] Assignee: KK Corporation, Tokyo, Japan

[21] Appl. No.: 78,032

[22] Filed: May 13, 1998

[30] Foreign Application Priority Data

May 16, 1997 [JP] Japan ..... 9-127276

[51] Int. Cl.[6] ..... A44B 19/00

[52] U.S. Cl. ..... 24/421; 24/419; 24/424; 24/429

[58] Field of Search ..... 24/421, 419, 424, 24/429

[56] References Cited

U.S. PATENT DOCUMENTS 3,793,684 2/1974 Moertel ..... 24/421
4,823,447 4/1989 Akashi ..... 24/419
4,829,638 5/1989 Ishii ..... 24/421
4,982,479 1/1991 Oda ..... 24/419

*Primary Examiner*—Victor N. Sakran
*Attorney, Agent, or Firm*—Hill & Simpson

[57] ABSTRACT

In a slide fastener slider, a slider body includes a pair of cantilevered arch-shape attachment lugs spaced from each other by a uniform-width hollow having a bottom surface sloping down to a front side of the slider body and standing on an upper wing at its front end and extending toward its rear end so as to define with the upper wing a gap for passage of an axle of a pull tab, a vertical spring-receiving hole formed through inner surfaces of bases of the attachment lugs into a guide post, a catch lever pivotally mounted between the attachment lugs and having at one end a hook, and a spring received in the spring-receiving hole with its upper end resiliently touching with the other end of the catch lever for urging the catch lever to pivotally move so as to normally close the gap by the hook. The pull tab various in kind can be attached to the assembled slider body.

8 Claims, 8 Drawing Sheets

SLIDE FASTENER SLIDER

BACKGROUND OF THE INVENTION

1. Field of the Invention

This invention relates to a slide fastener slider which, after a slider body has been assembled, a pull tab is attached to the slider body and is prevented from accidental removal.

2. Description of the Related Art

Many slide fastener sliders of the above-mentioned type are currently known. For example, Japanese Patent Publication No. Hei 1-14761 discloses a free-type slider which has a cantilevered arch-shape attachment lug integrally standing on an upper wing of a slider body at its front end and extending toward its rear end for holding an axle of a pull tab between the attachment lug and the upper wing, a recess formed in the upper surface of the upper wing in confronting relation to the rear end of the attachment lug for passage of the axle of the pull tab, and a resilient member supported by the slider body or the attachment lug for normally closing a gap between the upper wing and the rear end of the attachment lug. In production, for attaching the pull tab to the slider body, the resilient member is deformed by the axle of the pull tab so as to allow the axle to pass through the gap. Thus, the pull tab can be attached or detached freely Japanese Utility Model Publication No. Hei 4-32974 discloses an auto-lock slide fastener slider which has, as shown in FIG. 10 of the accompanying drawings of the present specification, an arch-shape pull-tab holder 20' pivotally mounted at its front end on an attachment lug 10' standing on the upper end of a guide post 5' and extends toward the rear end of an upper wing 3', and a locking lever 35' pivotally mounted on the attachment lug 10' at a position towards the guide post 5' with its rear end, i.e. a locking pawl 36', inserted in a locking-pawl-insertion hole 28' of the upper wing 3' and with its front end touching a spring 26' received in a small vertical hole in the guide post 5', the locking lever 35' having on its upper side a rearwardly opening recess 41' in which the axle of a pull tab is to be received to actuate the locking lever 35'. The rear end of the pull-tab holder 20' defines with the upper wing 3' a gap for passage of the axle of the pull tab. A gap-closing member 50' is slidably supported on the upper wing 3' for movement between a gap-closing position and a gap-opening position towards the guide post 5'. By pushing the gap-closing member 50' away from the gap by the axle, the pull tab can be threaded onto and removed off the pull-tab holder 20' via the gap.

Republic Chinese Patent No. 264642 discloses a slide fastener slider with an automatic locking mechanism which has, as shown in FIG. 11 of the accompanying drawings of the present specification, a cantilevered arch-shape attachment lug 10" standing on the upper wing 3" at its rear end and extending toward its front end, i.e. the upper end of a guide post 5", so as to define between a downwardly bent front end of the attachment lug 10" and the upper surface of the guide post 5" a gap for passage of an axle of a pull tab, a spring 26" received in a first vertical through-hole 16"-1 of the guide post, a gap-closing member 50" supported on the upper end of the spring 26" and normally urged against a lower surface of the front end of the attachment lug 10' for closing the gap 14", a second vertical through-hole 16'-2 extending in the front end of the attachment lug in alignment with the first vertical through-hole 16"-1, a horizontal lockinglever-attaching hole 42" perpendicularly crossing the second vertical through-hole 16"-2 in the front end of the attachment lug 10", a resilient locking lever 35" received in the locking-lever-attaching hole 42" with its rear end, e.g. a locking pawl 36", inserted in a locking-pawl-insertion hole 28" of the upper wing 3' to retractably project into a guide channel 7" of the slider body 1", and a locking-lever-anchoring strip 60' inserted in a slot 43" of the base of the locking lever to secure the locking lever 35". By pushing the gap-closing member 50" downwardly off the front end of the attachment lug 10" by the axle, the pull tab can be threaded onto the attachment lug 10" via the gap 14".

However, in the slider disclosed the first-named publication, partly since the pulling force of the pull tab acts directly on the resilient member and partly since the resilient member is supported in the attachment lug, a stable pull-tab-catching mechanism cannot be achieved. Further, since the pull-tab attaching and detaching mechanism and the pull-tab holding mechanism are complex, it is difficult to achieve a simple assembling of the slider, thus the resulting slider is not suitable for an automated assembling process.

In the auto-lock slider shown in FIG. 10 and disclosed in the second-named publication, due to its complicated structure, it is difficult to take appropriate adjustments for smooth actuation and operation. Also, since either the automatic locking mechanism or the gap-closing mechanism is composed of a rather large number of parts, efficient assembling is difficult to achieve and, as a consequence, this prior art slider is not suitable for automated assembling. Furthermore, this slider is necessarily large in height due to its peculiar structure, can not be made flat in structure and hence not neat in appearance.

Also in the auto-lock slider shown in FIG. 11 and disclosed in the third-named publication, it is difficult to assemble the automatic locking mechanism and the pull-tab-removal preventing mechanism in a streamlined process on an automatic assembling machine. As a consequence, this prior art slider is not suitable for automated assembling. Further, after the pull tab has been attached to the slider body, the axle of the pull tab comes directly into contact with the gap-closing member 50" and might therefore fail to actuate the locking lever 35" so as to retract the locking pawl 36" off the fastener element rows.

SUMMARY OF THE INVENTION

It is therefore a primary object of this invention to provide a slide fastener slider in which a pull tab can be attached to an attachment lug on a slider body after all the other members of the slider are assembled, which has a simple structure composed of a reduced number of parts and can hence be produced in a simple automated assembling process and which is free from fault and excellent in operativity and has a flat contour neat in overall appearance.

A second object of the invention is to provide a slide fastener slider in which the axle of a pull tab can be smoothly guided to tough attachment lugs on the slider body when the pull tab is pulled and can hence secure a smooth movement on a slide fastener chain.

A third object of the invention is to provide a slide fastener slider which, after having been attached to the attachment lugs on the slider body, the pull tab is free from being inadvertently removed off the slider body when it is pulled in any direction.

A fourth object of the invention is to provide a slide fastener slider in which, after having been attached to the attachment lugs on the slider body, the pull tab can be guided surely and reliably to the tough attachment lugs when it is pulled and which has a simple pull-tab-removal preventing mechanism using one selected from various types of springs.

A fifth object of the invention is to provide an auto-lock slide fastener slider which can be assembled simply and in which the automatic mechanism can be operated smoothly.

A sixth object of the invention is to provide an auto-lock slide fastener slider in which the locking lever can be smoothly actuated by pulling the pull tab, thus performing a locking function reliably and easily.

According to a first aspect of the invention, there is provided a slide fastener slider comprising: a slider body composed of upper and lower wings joined at their front ends by a guide post; a pair of cantilevered arch-shape attachment lugs parallel spaced from each other by a uniform-thickness hollow, each standing on an upper surface of the upper wing at a front end the slider body and extending toward a rear end of the slider body so as to define with the upper surface of the upper wing a gap; a pull tab having at its one end an axle adapted to pass through the gap; the attachment lugs having their bases having a spring-accommodation portion extending from the hollow into the guide post; a catch lever pivotally attached to the bases of the attachment lugs for pivotal movement in the hollow so as to close the gap by its one end; and a spring received in the spring-accommodation portion with its upper end resiliently touching with the other end of the catch lever for urging the catch lever to pivotally move so as to normally close the gap by the one end.

According to a second aspect of the invention, the one end of the catch lever is inwardly obliquely bent to be a hook.

According to a third aspect of the invention, the upper wing has in its upper surface in confronting relation to the hook of the catch lever a recess in which the hook is normally received under the resilience of the spring.

According to a fourth aspect of the invention, inner edges of the attachment lugs come substantially in lateral alignment with an inner edge of the catch lever when the gap is closed by the hook of the catch lever, the spring-accommodation portion being a vertical hole extending through confronting inner surfaces of the bases of the attachment lugs into the guide post, the spring being a coil spring to be received in the vertical hole with its upper end resiliently touching the other end of the catch lever, the hollow having at the bases of the attachment lugs a bottom surface sloping down to the vertical hole.

According to a fifth aspect of the invention, inner edges of the attachment lugs come substantially in lateral alignment with an inner edge of the catch lever when the gap is closed by the hook of the catch lever, the spring-accommodation portion being a spring-receiving recess formed in a bottom surface of the hollow at the bases of the attachment lugs, the spring being a U-shape leaf spring to be received in the spring-receiving recess with its upper part resiliently touching the other end of the catch lever.

According to a sixth aspect of the invention, inner edges of the attachment lugs come substantially in lateral alignment with an inner edge of the catch lever when the gap is closed by the hook of the catch lever, the spring-accommodation portion being a spring-receiving recess formed in a bottom surface of the hollow at the bases of the attachment lugs and having a bottom sloping down toward the front end of the slider body, the spring being a flat leaf spring to be received substantially horizontally in the spring-receiving recess with its front end resiliently touching the other end of the catch lever and with its rear end fixed to the slider body.

According to a seventh aspect of the invention, the slider is an auto-lock slider including a generally horizontal L-shape locking lever, the upper wing having in its upper surface a locking-pawl-insertion hole and a generally inverted L-shape locking-lever-receiving groove equal in thickness to the hollow and extending between the guide post and the locking-pawl-insertion hole, the locking lever being supported in and along the locking-lever-receiving groove and having at its rear end a locking pawl to be inserted in the locking-pawl-insertion hole with its front end touching the spring and the catch lever at the lower and upper sides thereof respectively, and has a central bent portion frictionally touching a lower surface of the catch lever on the upper side thereof, the inner edge of the catch lever being out of alignment with the inner edges of the attachment lugs so as to be seen from outside.

According to an eighth aspect of the invention, the locking lever is upwardly bent at its front end to form an upwardly concave portion, the catch lever having at the other end a projection frictionally touching an inside surface of the concave portion.

DETAILED DESCRIPTION OF THE PREFERRED EMBODIMENTS

Various preferred embodiments of this invention will now be described in detail with reference to the accompanying drawings.

Figure 1:
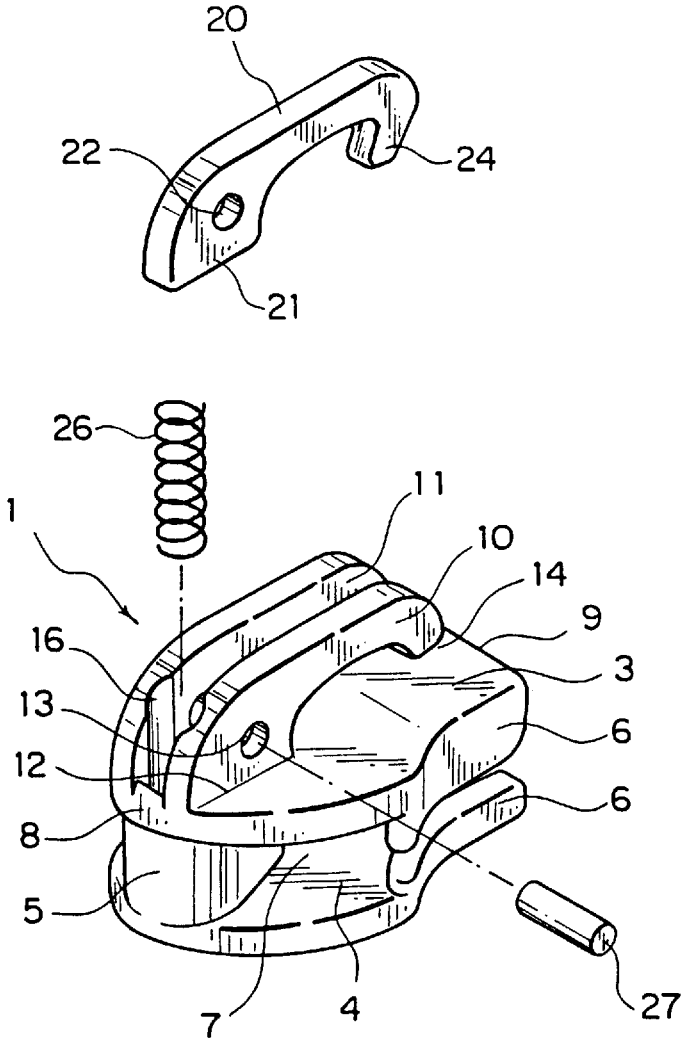
FIG. 1 is an exploded perspective view of a free-type slide fastener slider according to a first embodiment of this invention.
Figure 2:
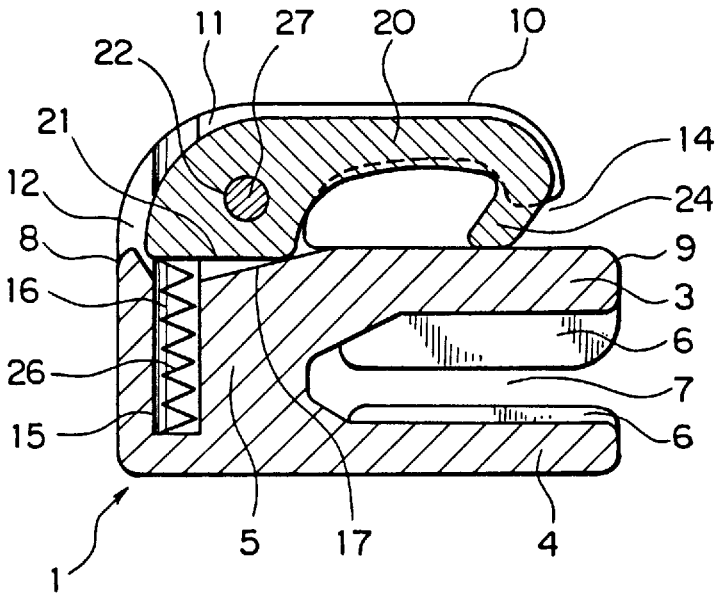
FIG. 2 is a longitudinal cross-sectional view showing the slider of the first embodiment with a pull tab being detached.
Figure 3:
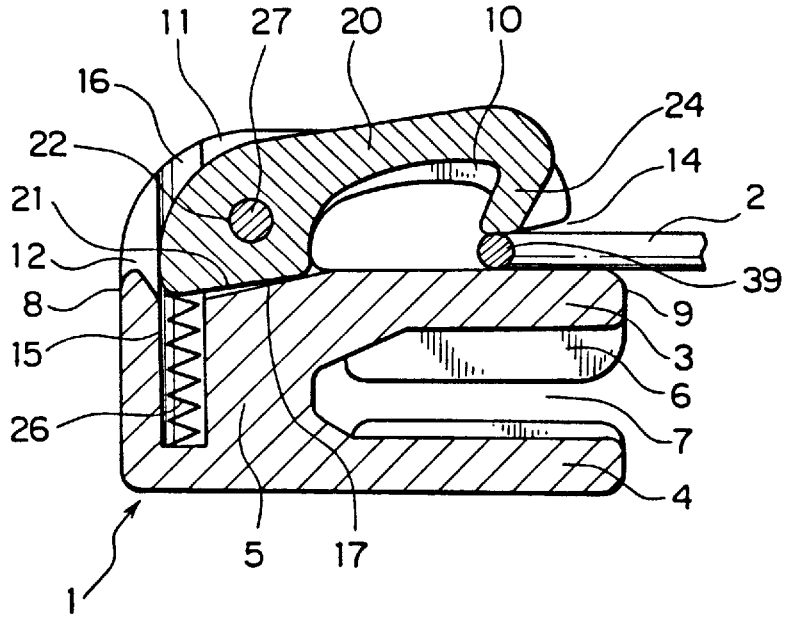
FIG. 3 is a longitudinal cross-sectionalview, showing the manner in which the detachable pull tab is attached to a slider body.
Figure 5:
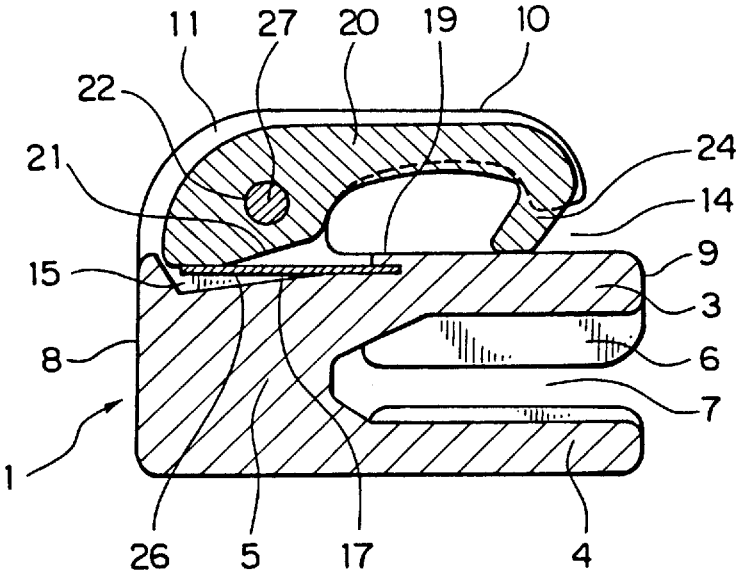
FIG. 5 is a longitudinal cross-sectional view showing another modified free-type slide fastener slider, with a pull tab being detached, according to a third embodiment of the invention.
Figure 6:
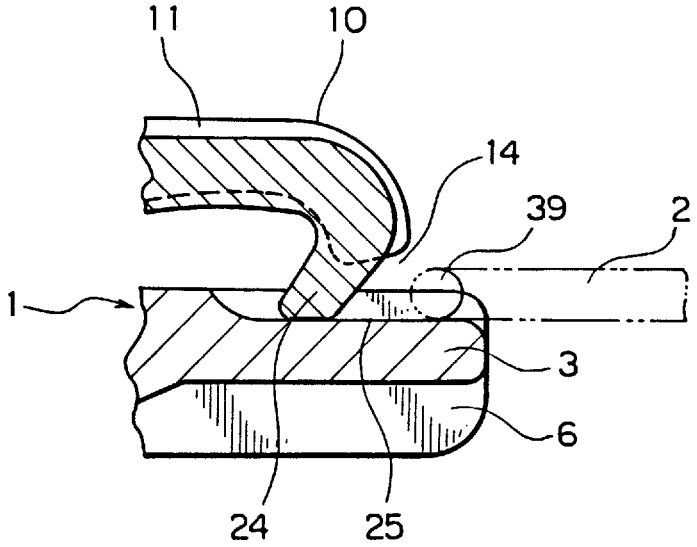
FIG. 6 is a fragmentary longitudinal cross-sectional view showing still another modified free-type slide fastener slider with a detachable pull tab according to a fourth embodiment of the invention.
Figure 7:
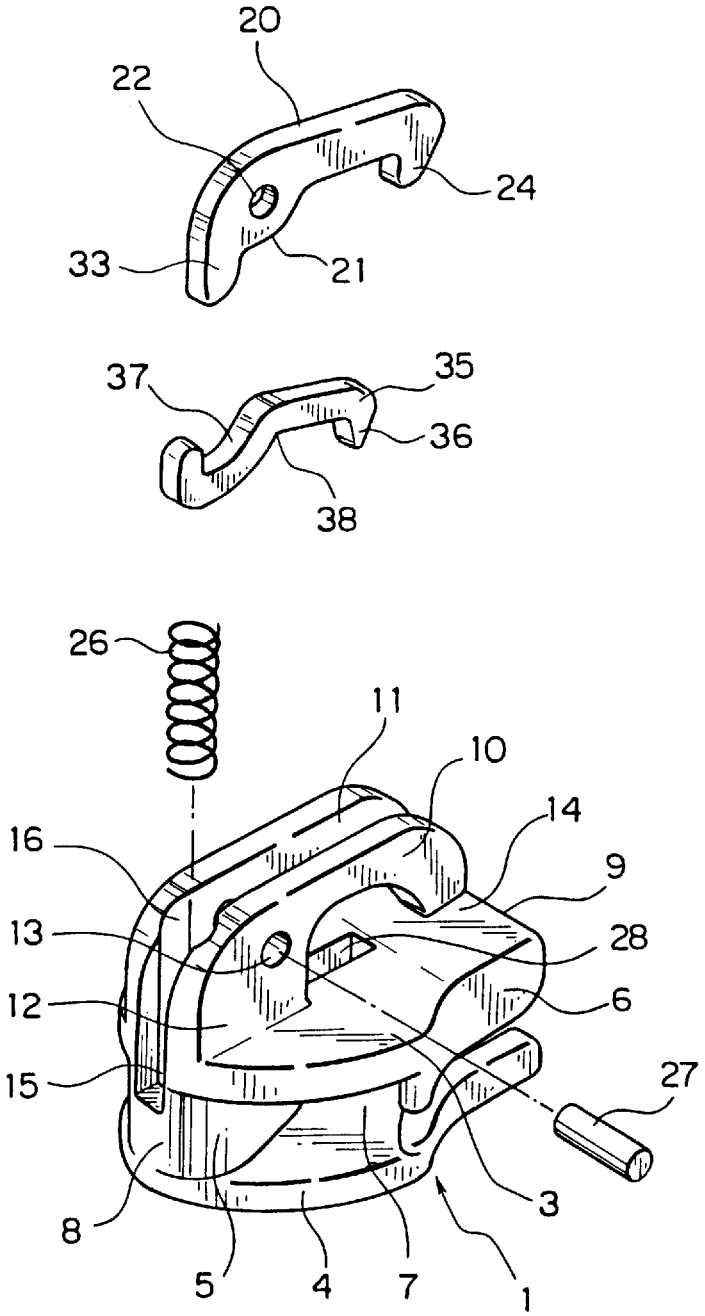
FIG. 7 is an exploded perspective view of an auto-lock slide fastener slider according to a fifth embodiment of the invention.
Figure 8:
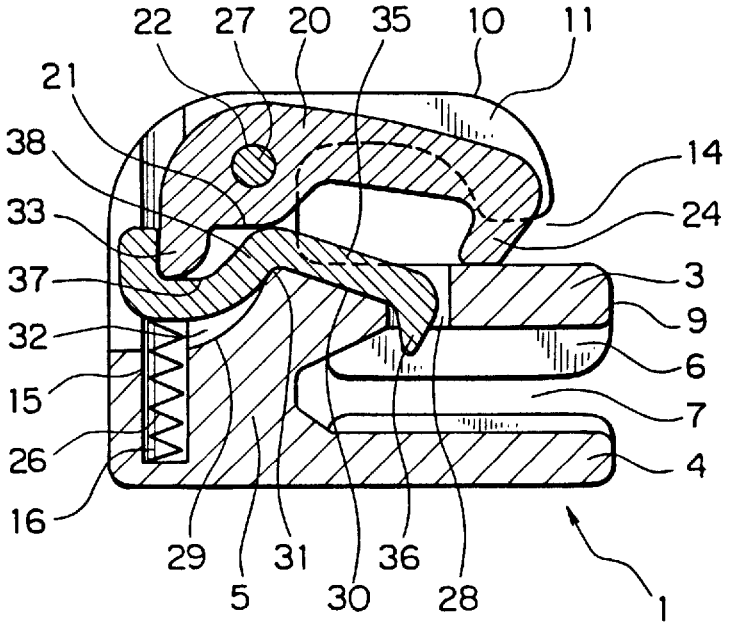
FIG. 8 s a longitudinal cross-sectional view showing the slider of the fifth embodiment with a pull tab being detached.
Figure 9:
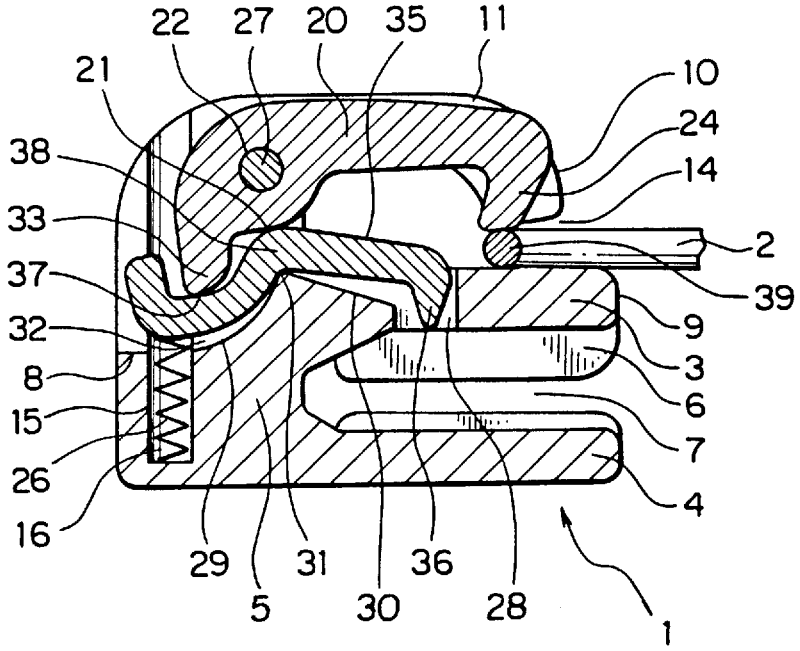
FIG. 9 is a longitudinal cross-sectional view, showing the manner in which the pull tab is attached to a slider body.
Figure 10:
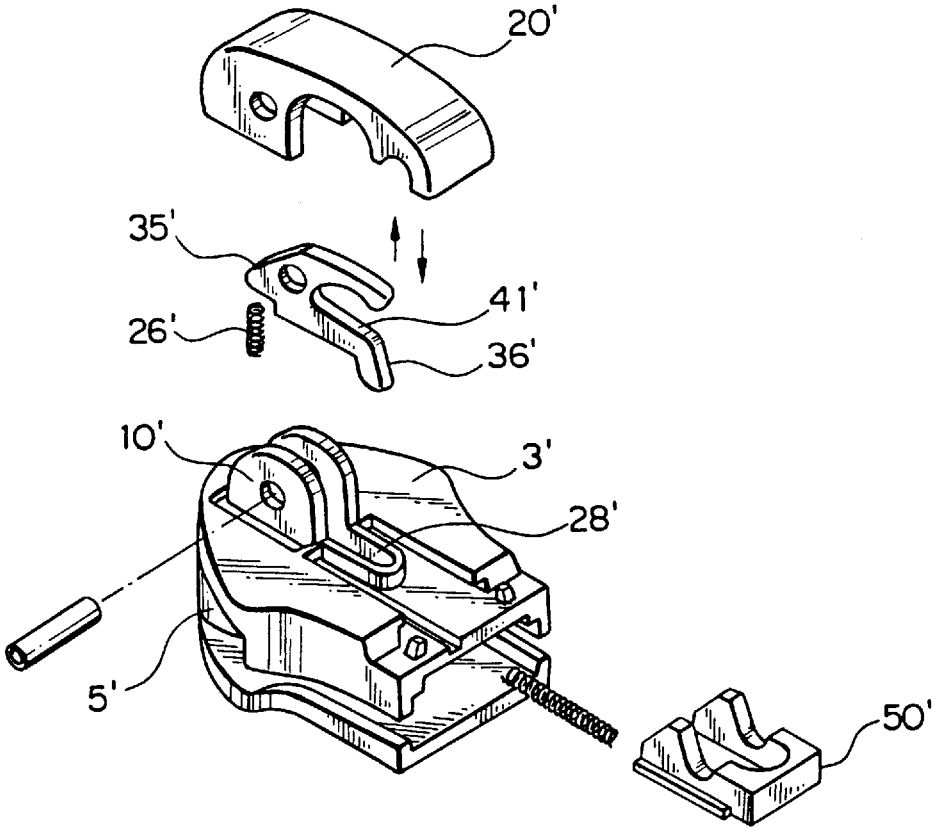
FIG. 10 PRIOR ART
FIG. 10 is an exploded perspective view of a convention auto-lock slide fastener slider with a pull tab being detached.
Figure 11:
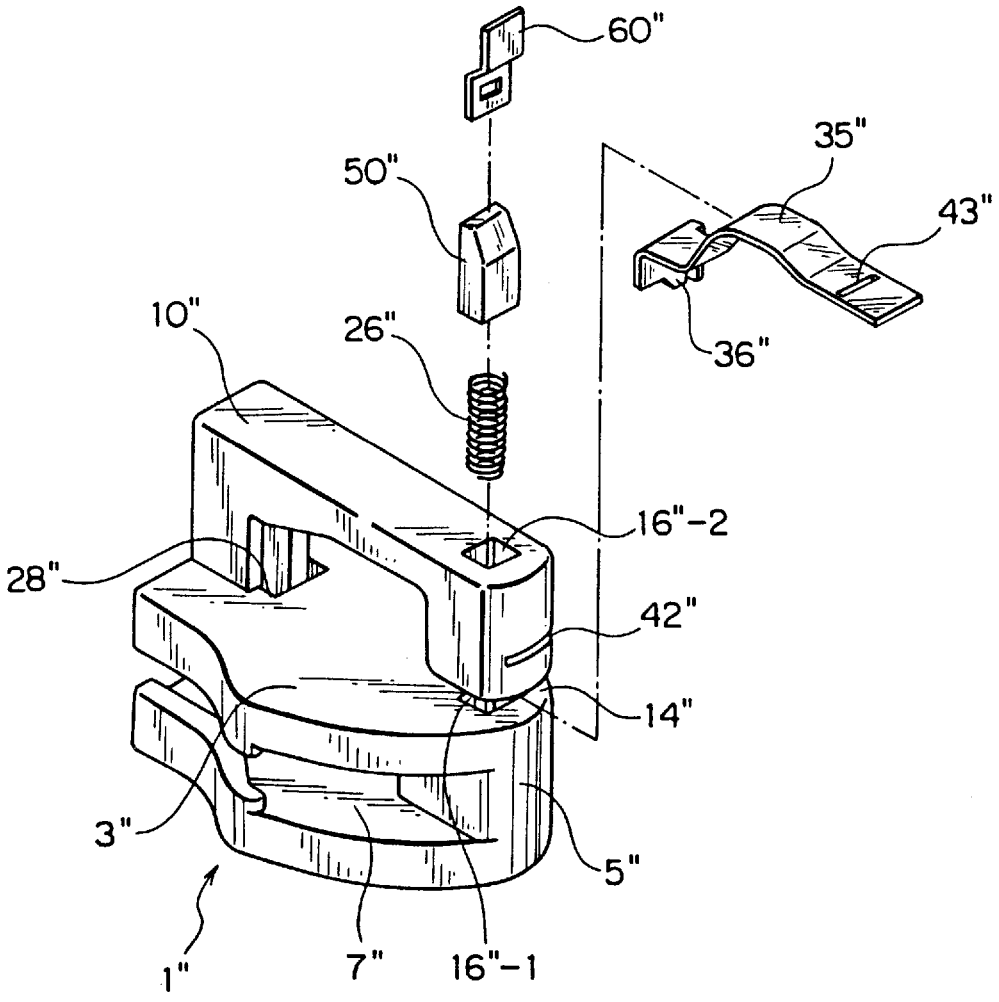
FIG. 11 PRIOR ART
FIG. 11 is an exploded perspective view of another conventional auto-lock slide fastener slider with a pull tab being detached.

FIGS. 1–6 show several different free-type slide fastener sliders, and FIGS. 7–9 shows an auto-lock slide fastener slider. More particularly, FIGS. 1–3 show a free-type slider according to a first embodiment in which a slider body 1 is composed of upper and lower wings 3, 4 joined at their front ends by a guide post 5, each of upper and lower wings 3, 4 having a pair of guide flanges 6 bent from opposite side edges, thus defining between the upper and lower wings 3, 4 a guide channel 7 for passage of a pair of rows of fastener elements. Alternatively, the slider body may have a pair of guide flanges 6 on one of the upper and lower wings 3, 4.

The slider body 1 further has on the upper surface of the upper wing 3 thereof a pair of arch-shape attachment lugs 10, to which a pull tab 2 is to be attached, extending from a front end 8 toward a rear end 9 of the slider body 1. Each of the attachment lugs 10 has a downwardly bent rear end defining with the upper surface of the upper wing 3 a gap 14 for passage of an axle 39 of the pull tab 2. The attachment lugs 10 have relatively wide bases 12 projecting from the upper surface of the guide post 5 and are parallel spaced from each other so as to define hollow 11 having a uniform-thickness along their entire length, so that a catch lever 20 is pivotally received in the hollow 11 for pivotal movement about a horizontal pivot 27 extending through in a pair of pivot holes 13 of the bases 12 of the attachment lugs 10 and a pivot hole 22 of the catch lever 20.

The attachment lugs 10 define jointly with the guide post 5 a spring-accommodation portion 15 in the form of a vertical hole 16 having a circular cross-sectional shape and extending from the inside surfaces of the bases 12 into the guide post 5. The hollow 11 has between the bases 12 a bottom surface 17 sloping down to the front side. A coil spring 26 is inserted in the vertical hole 16 so as to slightly project from the bottom surface 17 of hollow 11.

The catch lever 20 has a longitudinally-thick base end 21 to come into contact with the sloping bottom surface 17 of the hollow 11, and is pivotally mounted in the hollow 11 between the attachment lugs 10. On the other hand, the rear end of the catch lever 20 is bent obliquely inwardly as a hook 24 for normally closing the gap 14 between the rear ends of the attachment lugs 10 and the upper wing 3. The catch lever 20 has a shape such as to be concealed by the attachment lugs 10 when it is received in the attachment lug 10; more particularly, when the hook 24 touches the upper wing 3 to close the gap 14 under the resiliency of the coil spring 26 as described below, the inner edge of the catch lever 20 comes into lateral alignment with the inner edges of the attachment lugs 10, as shown in FIG. 2 in such a manner that the axle 39 of the pull tab 2 can slide along inner edges of the attachment lugs 10 after the pull tab 2 has been attached on the attachment lugs 10.

In production, firstly the slider body 1 and the catch lever 20 are molded of metal, such as aluminum alloy or zinc alloy, by die casting and are then assembled with the coil spring 26 and the pivot 27, both made of metal, by an automated assembling process, whereupon the pull tab 2, which may have a desired shape, is attached to the resulting slider body 1. Alternatively the slider body 1 and the catch lever 20 may be formed of thermoplastic resin, such as polyacetal, polyamide, polypropylene or polybutyleneterephthalate, by injection molding or extrusion molding.

In this assembling, the coil spring 26 is inserted into the vertical hole 16 of the attachment lugs 10 from its upper end and then the catch lever 20 is inserted in the hollow 11 between the attachment lugs 10 in such a manner that its base 21 resiliently touches the spring 26 and that the pivot holes 13 of the attachment lugs 10 axially aligns with the pivot hole 22 of the catch lever 20, whereupon the pivot 27 is inserted through these pivot holes 13, 22 and is then fixed to the bases 12 of the attachment lugs 10 by such a means as clenching its opposite ends. Thus the catch lever 20 is pivotally mounted on the attachment lugs 10 in such a manner that the hook 24 normally close the gap 14 under the resiliency of the spring 26. Then, the assembling of the slider body 1 is completed. Upon completion of this assembling, the hook 24 of the catch lever 20 is pushed upwardly off the gap 14 by the axle 39 of the pull tab 2 as shown in FIG. 3, causing the lower end of the base 21 to compress the spring 26 and to come into contact with the sloping bottom surface 17 of the hollow 11 so that the axle 39 of the pull tab 2 is allowed to pass through the gap 14. As a result, the attaching of the pull tab 2 to the slider body 1 is completed, so that the slider can be slid by handling the pul tab 2 forwardly and backwardly.

Figure 4:
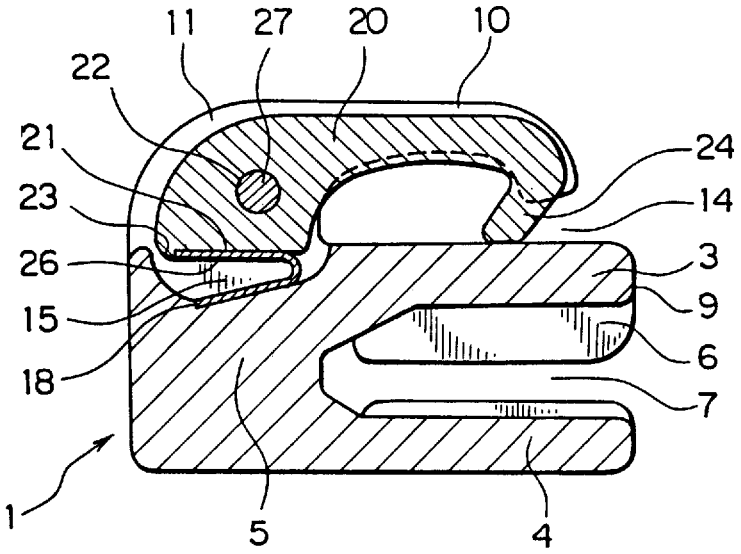
FIG. 4 is a longitudinal cross-sectional view showing a modified free-type slide fastener slider, with a pull tab being detached, according to a second embodiment of the invention.

FIG. 4 shows a modified free-type slide fastener slider according to a second embodiment of the invention. The slider body 1 of this modified slider is similar in construction with that of the first embodiment except that the spring-accommodation portion 15 is in a form of a spring-receiving recess, deeper at the front side, extending into the guide post 5 from the upper surface of the upper wing 3 with the same width as the hollow 11 and terminating far short of the lower end of the guide post 5 in the upper surface of the guide post 5 and that a U-shape leaf spring 26 is fitted in a stepped portion 18 in the bottom surface of the spring-receiving recess 15.

On the other hand, the base 21 of the catch lever 20 has a substantially horizontal bottom and a projection 23 at its front edge for holding the U-shape leaf spring 26 stably in position. As already mentioned, when the catch lever 20 closes the gap 14 by the hook 24, its inner edge comes substantially into lateral alignment with the inner edges of the attachment lugs 10, which gives an improved degree of resistance against possible strong pulling of the pull tab 2.

For assembling the slider body 1, the U-shape leaf spring 26 is placed in the spring-receiving recess 15 in the guide post 5 through the hollow 11 of the attachment lugs 10 with a front end of its lower part fitted in the stepped portion 18 of the sloping bottom of the recess 15, whereupon the catch lever 20 is placed in the hollow 11 from the upper side with an front end of its upper part of the U-shape leaf spring 26 resiliently contacting with touching the projection 23 of the bottom of the base 21 of the catch lever 20. At that time, the pivot hole 22 of the catch lever 20 is axially aligned with the pivot holes 13 of the attachment lugs 10. Then the pivot 27 is inserted through the aligned pivot holes 13, 22, so that the catch lever 20 can be pivotally movable. Thus, the assembling of the slider body 1 is completed. After completion of this assembling, the hook 24 of the catch lever 20 is pushed upwardly off the gap 14 from the rear side by the axle 39 of the pull tab 2 against the resiliency of the U-shape leaf spring 26 so that the axle 39 of the pull tab 2 is allowed to pass through the gap 14. As a result, the attaching of the pull tab 2 to the slider body 1 is completed.

FIG. 5 shows another modified free-type slide fastener slider according to a third embodiment of the invention. This slider is similar in construction to the previous slider of FIG. 4 except that a flat leaf spring 26 is horizontally received in a rather shallow spring-receiving recess 15 extending into the guide post 5 with the same width as the hollow 11. This shallow recess 15 also has a bottom surface 17 sloping down to the front side, facilitating the action of the flat leaf spring 26. Reference number 19 designates an anchoring projection at a rear end of the shallow recess 15 and is to be clenched to hold an rear end of the flat leaf spring 26.

On the rear end of the catch lever 20, the hook 24 serves to close the gap 14 likewise the previous embodiment. On the front end of the catch lever 20, the rear bottom of the base 21 has an arcuate surface gradually curving toward its rear edge in order to press the flat leaf spring 26 down adequately to resiliently deform. Likewise the previous embodiment, when the catch lever 20 closes the gap 14 by the hook 24, its inner edge comes substantially in lateral alignment with the inner edges of the attachment lugs 10.

For assembling the slider body 1, the flat leaf spring 26 is substantially horizontally placed in the shallow recess 15 in the guide post 5 through the hollow 11 of the attachment lugs 10 with the rear end of the spring contacting with the anchoring projection 19 at the rear edge of the shallow recess 15, whereupon the anchoring projection 19 is clenched to fix the rear end of the flat leaf spring 26. Then over the flat leaf spring 26, the catch lever 20 is placed in the hollow 11 from the upper side with the front bottom end resiliently resting on the flat leaf spring 26 and is pivotally mounted on the attachment lugs 10 by the pivot 27, completing the assembling of the slider body 1. After completion of this assembling, the hook 24 of the catch lever 20 is pushed upwardly off the gap 14 from the rear side by the axle 39 of the pull tab 2 against the resiliency of the flat leaf spring 26 so that the axle 39 of the pull tab 2 is allowed to pass through the gap 14. As a result, the attaching of the pull tab 2 to the slider body 1 is completed.

FIG. 6 shows still another modified free-type slide fastener slider according to a fourth embodiment of the invention. This modified slider is differentiated over the foregoing sliders by having a hook-receiving recess 25 at the rear end 9 of the upper wing 3 in confronting relation to the rear ends of the attachment lugs 10. This hook-receiving recess 25 extends over a wide range covering the lower surfaces of the rear ends of the attachment lugs 10. This modification is particularly useful when the pull tab 2 is of the type having at one end an attaching ring instead of an axle; in this case, the hook-receiving recess 25 is substantially analogous in contour to the attaching ring 39, makes it possible to make the actual gap between the rear ends of the attaching lugs 10 and the upper surface of the upper wing 3 smaller than the thickness of the attaching ring 39 of the pull tab 2. With this arrangement, even if the pull tab 2 is pulled in any posture, the pull tab 2 is prevented from accidental removal off the slider body 1 by pushing the hook 24 of the catch lever 20 upwardly.

FIGS. 7–9 show an auto-lock slide fastener slider according to a fifth embodiment of the invention. This slider is identical in construction with the foregoing free-type sliders except that it is equipped with an automatic locking mechanism. In this auto-lock slider, like the foregoing free-type sliders, a slider body 1 is composed of upper and lower wings 3, 4 joined at their front ends by a guide post 5, each of upper and lower wings 3, 4 having a pair of guide flanges 6 bent along its opposite side edges so as to define between the upper and lower wings 3, 4 a guide channel 7 for passage of a pair of rows of fastener elements.

The slider body 1 further has on the upper surface of the upper wing 3 thereof a pair of arch-shape attachment lugs 10, to which a pull tab 2 is to be attached, extending a front end 8 toward a rear end 9 of the slider body 1. Each of the attachment lugs 10 has a downwardly bent rear end defining with the upper surface of the upper wing 3 a gap 14 for passage of an axle 39 of the pull tab 2. The attachment lugs 10 have relatively wide bases 12 projecting from the upper surface of the guide post 5 and are parallel spaced from each other so as to define a hollow 11 having a uniform-thickness along their entire length, so that a catch lever 20 is pivotally mounted in the hollow 11 for pivotal movement about a horizontal pivot 27 extending through in a pair of pivot holes 13 of the bases 12 of the attachment lugs 10 and a pivot hole 22 of the catch lever 20. The attachment lugs 10 define jointly with the guide post 5 a spring-accommodation portion 15 in a form of a vertical hole 16 having a circular cross-sectional shape and extending from the inside surfaces of the bases 12 at a position toward the front end 8 into the guide post 5.

As a typical characteristic feature of the auto-lock slider, the upper wing 3 has at its center a locking-pawl-insertion hole 28 communicating with the guide channel 7. The hollow 11 at the wide bases 12 of the attachment lugs 10 has an arcuate bottom 29 deep at the front end 8 of the slider body 1, an inclined surface 30 sloping down from a peak 31, i.e. the rear edge of the bottom 29, to the locking-pawl-insertion hole 28, and a locking-lever-receiving groove 32 formed centrally in the bottom 29 for receiving a generally inverted L-shape locking lever 35.

On the other hand, the catch lever 20 to be received in the hollow 11 between the attachment lugs 10 has a hook 24 at its rear end for normally closing the gap 14 between the rear ends of the attachment lugs 10 and the upper wing 3 and a longitudinally wide base end 12 at its front end. The catch lever 20 has such a shape that, when the hook 24 touches the upper wing 3 to close the gap 14 under the resiliency of the coil spring 26 as described below, the inner edge of the catch lever 20 comes out of lateral alignment with the inner edges of the attachment lugs 10 so as to be seen from outside; that is, the inner edge of the catch lever 20 projects downwardly of the inner edges of the attachment lugs 10. When the pull tab 2 is pulled upwardly, the axle 39 of the pull tab 2 slides along the inner edge of the catch lever 20 about the pivot 27.

The generally inverted L-shape locking lever 35 has at one end a locking pawl 36 bent so as to be inserted into the locking-pawl-insertion hole 28, and its half part at the other end has such a shape as to be loosely received in the arcuate bottom 29 of the slider body 1. On the end of the half part is bent so as to form an arcuate part 37. The locking lever 35 at is bent at a rear end of the arcuate portion 37 to form a bent portion 38.

In production, the slider body 1, the catch lever 20 and the locking lever 35 are molded using the same kind of material as that used in the foregoing embodiments and are then assembled by an automated assembling process, whereupon the pull tab 2 is attached to the resulting slider body 1. During this assembling, the coil spring 26 is inserted into the vertical hole 16 of the attachment lugs 10 from its upper end and then the locking lever 35 is placed in the locking-lever-receiving groove 32 from the upper side via the hollow 11 with its central bent portion 38 supported on the peak 31 of the locking-lever-receiving groove 32, with its rear end, i.e. the locking pawl 36, inserted into the locking-pawl-insertion hole 28 and also with a lower surface of its front end, i.e. the arcuate portion 37, touching the upper end of the spring 26. Then, the catch lever 20 is inserted in the hollow 11 from the upper side with the projection frictionally received in the arcuate portion 37 of the locking lever 35. At that time, the pivot holes 13 of the attaching lugs 10 are axially aligned with the pivot hole 22 of the catch lever 20, the pivot 27 is inserted through these pivot holes 13, 22 and is then fixed at its opposite ends to the bases 21 of the attachment lugs 10, thus completing the assembling of the slider body 1. As the catch lever 20 is pivotally moved about the pivot 27, the locking lever 35 follows to pivotally move about the peak 31.

After completion of this assembling, the hook 24 of the catch lever 20 is pushed upwardly off the gap 14 from the rear side by the axle 39 of the pull tab 2 as shown in FIG. 9 so that the axle 39 of the pull tab 2 is allowed to pass through the gap 14. As a result, the auto-lock slider has been completed. If the pull tab 2 is pulled forwardly or rearwardly, the axle 39 raises the catch lever 20 to pivotally move so that the projection 33 of the base 21 of the catch lever 20 pushes the concave portion 37 of the locking lever 35 downwardly, causing the locking pawl 36 to retract from the guide channel 7 and hence allowing the slider to slide in either direction.

Alternatively, the coil spring 26 may be replaced with a U-shape leaf spring 26 as shown in FIG. 4, in which case the spring-receiving groove 32 is concealed at a front side 8 of the slider body 1, supporting the front end of the locking lever 35.

With the slider of this invention, following advantageous results can be achieved:

According to a first aspect of the invention, partly since the upper wing 3 has a pair of parallel spaced arch-shape attachment lugs 10 stands on the guide post 5 at the front end 8 of the slider body 1 extending toward the rear end 9 thereof, so as to define with the upper wing 3 a gap 14 for passage of the axle 39 of the pull tab 2, partly since a spring-accommodation portion 15 is formed in confront inner surfaces of the bases 12 of the attachment lugs 10 extending into the guide post 5, and partly since a catch lever 20 is pivotally mounted in the hollow 11 between the attachment lugs 10 in such a manner that one end resiliently contacts with the spring 26 received in the spring-accommodation portion 15 while the other end serves to close the gap, it is possible to reduce the number of parts of the free-type slider as well as one having automatic locking mechanism, facilitating supplying parts to the assembling station and simplifying the assembling process. As a consequence, a slider flat in contour and hence neat in overall appearance can be assembled simply on an automatic assembling machine at improved rate of production.

According to a second aspect of the invention, since one end of the catch lever 20 is inwardly obliquely bent as a hook 24 in order to close the gap 14, the pull tab 2 can be attached to the slider body 1 in a simple manner and is prevented from inadvertent removal. Further, the axle 39 of a pull tab 2 can be smoothly guided to tough attachment lugs 10 when the pull tab 2 is pulled and can hence secure a smooth movement on a slide fastener chain.

According to a third aspect of the invention, since the upper wing 3 has in its upper surface in confronting relation to the hook 24 of the catch lever 20 a recess 25 in which the hook 24 is normally received under the resilience of the spring 26 so that the hook 24 can resiliently touch the recess 25, the pull tab 25 is free from being inadvertently removed off the slider body 1 when it is pulled in any direction.

According to a fourth aspect of the invention, partly since inner edges of the attachment lugs 10 come substantially in lateral alignment with an inner edge of the catch lever 20 when the gap 14 is closed by the hook 24 of the catch lever 20, partly since the spring-accommodation portion 15 is a vertical hole 16 extending through confronting inner surfaces of the bases 12 of the attachment lugs 10 into the guide post 5, partly since the spring 26 is a coil spring received in the vertical hole 16 with its upper end resiliently touching the other end of the catch lever 20, and partly since the hollow 11 has at the bases 12 of the attachment lugs 10 a bottom surface sloping down to the vertical hole 16, the pull tab 2 can be guided surely and reliably to the tough attachment lugs 10 when it is pulled, and the slider can have a reliable pull-tab-removal preventing mechanism using the coil spring which can be mounted in the slider body 1 in a simple manner by an automatic assembling machine, particularly when it is a slider without automatic locking mechanism.

According to a fifth aspect of the invention, partly since inner edges of the attachment lugs 10 come substantially in lateral alignment with an inner edge of the catch lever 20 when the gap 14 is closed by the hook 24 of the catch lever 20, partly since the spring-accommodation portion 15 is a spring-receiving recess formed in a bottom surface of the hollow 11 at the bases 12 of the attachment lugs 10, and partly since the spring 26 is a U-shape leaf spring to be received in the spring-receiving recess with its upper part resiliently touching the other end of the catch lever 20, the pull tab 2 can be guided surely and reliably to the tough attachment lugs 10 when it is pulled, and the slider can have a reliable pull-tab-removal preventing mechanism using the U-shape leaf spring which can be mounted in the slider body 1 in a simple manner by an automatic assembling machine, particularly when it is a slider without automatic locking mechanism.

According to a sixth aspect of the invention, inner edges of the attachment lugs 10 come substantially in lateral alignment with an inner edge of the catch lever 20 when the gap 14 is closed by the hook 24 of the catch lever 20, partly since the spring-accommodation portion 15 is a spring-receiving recess formed in a bottom surface of the hollow 11 at the bases 12 of the attachment lugs 10 and having a bottom sloping down toward the front end 8 of the slider body 1, and partly since the spring 26 is a flat leaf spring received substantially horizontally in the spring-receiving recess with its front end resiliently touching the other end of the catch lever 20 and with its rear end fixed to the slider body 1, the pull tab 2 can be guided surely and reliably to the tough attachment lugs 10 when it is pulled, and the slider can have a reliable pull-tab-removal preventing mechanism using the flat leaf spring which can be mounted in the slider body 1 in a simple manner by an automatic assembling machine, particularly when it is a slider without automatic locking mechanism.

According to a seventh aspect of the invention, partly since the slider is an auto-lock slider further including a generally horizontal L-shape locking lever 35, partly since the upper wing 3 has in its upper surface a locking-pawl-insertion hole 28 and a generally inverted L-shape locking-lever-receiving groove 32 equal in thickness to the hollow 11 and extending between the guide post 5 and the locking-pawl-insertion hole 28, partly since the locking lever 35 is supported in and along the locking-lever-receiving groove 32 and having at its rear end a locking pawl 36 to be inserted in the locking-pawl-insertion hole 28 with its front end touching the spring 26 and the catch lever 20 at the lower and upper sides thereof respectively, and has a central bent portion 38 frictionally touching a lower surface of the catch lever 20 on the upper side thereof, and partly since the inner edge of the catch lever 20 is out of alignment with the inner edges of the attachment lugs 10 so as to be seen from outside, it is possible to assemble the auto-lock slider simply and to operate an automatic mechanism smoothly by the pull tab 2.

According to an eighth aspect of the invention, partly since the locking lever 35 is upwardly bent at its front end to form an upwardly concave portion 37, and partly since the catch lever 20 has at the other end a projection frictionally touching an inside surface of the concave portion 37, the locking lever 35 can be smoothly actuated by pulling the pull tab 2, thus performing a locking function reliably and easily.

What is claimed is:

1. A slide fastener slider comprising:

(a) a slider body composed of upper and lower wings joined at their front ends by a guide post;

(b) a pair of cantilevered arch-shape attachment lugs parallel spaced from each other by a uniform-thickness hollow, each standing on an upper surface of said upper wing at a front end of said slider body and extending toward a rear end of said slider body so as to define with said upper surface of said upper wing a gap;

(c) a pull tab having at its one end an axle adapted to pass through said gap when said pull tab is threaded onto said attachment lugs;

(d) said attachment lugs having their bases having with said guide post a spring-accommodation portion extending from said hollow into said guide post;

(e) a catch lever pivotally attached to said bases of said attachment lugs for pivotal movement in said hollow so as to close said gap by its one end; and (f) a spring received in said spring-accommodation portion with its upper end resiliently touching with the other end of said catch lever for urging said catch lever to pivotally move so as to normally close said gap by said one end.

2. A slide fastener slider according to claim 1, wherein said one end of said catch lever is inwardly obliquely bent to be a hook.

3. A slide fastener slider according to claim 1, wherein said upper wing has in its upper surface in confronting relation to said hook of said catch lever a recess in which said hook is normally received under the resilience of said spring.

4. A slide fastener slider according to claim 1, wherein inner edges of said attachment lugs come in substantially lateral alignment with an inner edge of said catch lever when said gap is closed by said hook of said catch lever, said spring-accommodation portion being a vertical hole extending through confronting inner surfaces of said bases of said attachment lugs into said guide post, said spring being a coil spring to be received in said vertical hole with its upper end resiliently touching said other end of said catch lever, said hollow having at said bases of said attachment lugs a bottom surface sloping down to said vertical hole.

5. A slide fastener slider according to claim 1, wherein inner edges of said attachment lugs come in lateral alignment with an inner edge of said catch lever when said gap is closed by said hook of said catch lever, said spring-accommodation portion being a spring-receiving recess formed in a bottom surface of said hollow at said bases of said attachment lugs, said spring being a U-shape leaf spring to be received in said spring-receiving recess with its upper part resiliently touching said other end of said catch lever.

6. A slide fastener slider according to claim 1, wherein inner edges of said attachment lugs come in lateral alignment with an inner edge of said catch lever when said gap is closed by said hook of said catch lever, said spring-accommodation portion being a spring-receiving recess formed in a bottom surface of said hollow at said bases of said attachment lugs and having a bottom sloping down toward said front end of said slider body, said spring being a flat leaf spring to be received substantially horizontally in said spring-receiving recess with its front end resiliently touching said other end of said catch lever and with its rear end fixed to said slider body.

7. A slide fastener slider according to claim 1, wherein the slider is an auto-lock slider further including a generally horizontal L-shape locking lever, said upper wing having in its upper surface a locking-pawl-insertion hole and a generally inverted L-shape locking-lever-receiving groove equal in thickness to said hollow and extending between said guide post and said locking-pawl-insertion hole, said locking lever being supported in and along said locking-lever-receiving groove and having at its rear end a locking pawl to be inserted in said locking-pawl-insertion hole with its front end touching said spring and said catch lever at the lower and upper sides thereof respectively, and has a central bent portion frictionally touching a lower surface of said catch lever on the upper side thereof, said inner edge of said catch lever being out of alignment with said inner edges of said attachment lugs so as to be seen from outside.

8. A slide fastener slider according to claim 7, wherein said locking lever is upwardly bent at its front end to form an upwardly concave portion, said catch lever having at said other end a projection frictionally touching an inside surface of said concave portion.

* * * * *

UNITED STATES PATENT AND TRADEMARK OFFICE

CERTIFICATE OF CORRECTION

PATENT NO. : 5,864,928

DATED : February 2, 1999

INVENTOR(S) : Hideyuki Matsushima

It is certified that error appears in the above-indentified patent and that said Letters Patent is hereby corrected as shown below:

On the title page, please change to

[73]Assignee: YKK Corporation, Tokyo, Japan

Signed and Sealed this

Twentieth Day of July, 1999

*Attest:*

Q. TODD DICKINSON

*Attesting Officer*

*Acting Commissioner of Patents and Trademarks*